US010247415B2

(12) United States Patent
Nakata

(10) Patent No.: US 10,247,415 B2
(45) Date of Patent: Apr. 2, 2019

(54) COMBUSTION CONTROLLING DEVICE AND COMBUSTION SYSTEM

(71) Applicant: Azbil Corporation, Tokyo (JP)

(72) Inventor: Tomoya Nakata, Tokyo (JP)

(73) Assignee: Azbil Corporation, Tokyo (JP)

( * ) Notice: Subject to any disclaimer, the term of this patent is extended or adjusted under 35 U.S.C. 154(b) by 350 days.

(21) Appl. No.: 15/130,004

(22) Filed: Apr. 15, 2016

(65) Prior Publication Data

US 2016/0305658 A1 Oct. 20, 2016

(30) Foreign Application Priority Data

Apr. 17, 2015 (JP) ..... 2015-084777

(51) Int. Cl.
*F23N 1/02* (2006.01)
*F23N 5/02* (2006.01)
*F23N 5/24* (2006.01)

(52) U.S. Cl.
CPC ..... *F23N 1/02* (2013.01); *F23N 5/02* (2013.01); *F23N 5/24* (2013.01); *F23N 2037/02* (2013.01)

(58) Field of Classification Search
CPC ..... F23N 1/02; F23N 5/24; F23N 5/02; F23N 2037/02
See application file for complete search history.

(56) References Cited

U.S. PATENT DOCUMENTS

2010/0307387 A1 12/2010 Yamada et al.
2011/0244407 A1 10/2011 Yamada et al.

FOREIGN PATENT DOCUMENTS

| | | | |
|---|---|---|---|
| CN | 101922730 | A | 12/2010 |
| JP | H03-99120 | A | 4/1991 |
| JP | H11-037460 | A | 2/1999 |
| JP | 2010-286128 | A | 12/2010 |
| JP | 2011-208921 | A | 10/2011 |
| KR | 10-1998-0017337 | A | 6/1998 |
| KR | 10-1998-0081138 | A | 11/1998 |

OTHER PUBLICATIONS

The State Intellectual Property Office of People's Republic of China, "Office Action", issued in Chinese Patent Application No. 201610231598.4, which is a CN counterpart of U.S. Appl. No. 15/130,004, dated Sep. 28, 2017, 15 pages (8 pages of English Translation of Office Action and 7 pages of Office Action).

(Continued)

*Primary Examiner* — Alfred Basichas
(74) *Attorney, Agent, or Firm* — Amster, Rothstein & Ebenstein LLP

(57) ABSTRACT

Safety and stability of combustion are improved by a combustion controlling device that controls the operation of 2 or more burners and stops all the operation of the burners when combustion states of the burners satisfy a predetermined condition, and the predetermined condition includes a first shutoff condition for stopping the operation of the burners at the time of an initial startup to ignite a desired burner from a state in which none of the burners is ignited, and a second shutoff condition for stopping the operation of the burners in a normal operating state after the desired burner has been normally ignited by the initial startup.

7 Claims, 8 Drawing Sheets

(56) References Cited

OTHER PUBLICATIONS

Korean Intellectual Property Office, "Office Action", issued in Korean Patent Application No. 10-2016-0046288, which is a KR counterpart of U.S. Appl. No. 15/130,004, dated Sep. 18, 2017, 9 pages (4 pages of English Translation of Office Action and 5 pages of Office Action).
Japanese Application No. JP2015-084777, filed Apr. 17, 2015.
Japan Patent Office, "Notice of Reasons for Refusal," issued in Japanese Patent Application No. 2015-084777, which is a JP counterpart of U.S. Appl. No. 15/130,004, dated Dec. 3, 2018, 6 pages (3 pages of English Translation of Office Action and 3 pages of Office Action).

COMBUSTION CONTROLLING DEVICE AND COMBUSTION SYSTEM

CROSS-REFERENCE TO RELATED APPLICATION

The present application claims the benefit of and priority to Japanese Patent Application No. 2015-084777, filed on Apr. 17, 2015, the entire contents of which are incorporated by reference herein.

TECHNICAL FIELD

The present invention relates to a combustion controlling device and a combustion system, and more particularly relates to a combustion controlling device that can enhance safety and stability of a combustion control.

BACKGROUND ART

In general, in combustion furnaces (combustion systems) typified by industrial furnaces such as a steel furnace, a deodorizing furnace and a heating furnace, a combustion control is performed by a combustion controlling device while monitoring a combustion state of a burner disposed in the combustion furnace, a furnace temperature, a pressure of a combustion air, and a pressure of a fuel to be supplied to the burner, to thereby ensure safe combustion. For example, the combustion controlling device performs a safety control that determines whether a flame caused by the burner is present, or not, with the use of a flame detector, and stops the supply of fuel to a combustion furnace when the flame is not detected (for example, refer to Patent Document 1).

PRIOR ART DOCUMENTS

Patent Documents

[Patent Document 1] JP-A-11-37460

SUMMARY OF THE INVENTION

Problems to be Solved by the Invention

Incidentally, in combustion systems having multiple burners (multi-burner systems), multiple burners are installed in a common combustion chamber (zone). In the present specification, the combustion chamber means a space in which combustion is controlled under a condition (parameter) where a temperature or a pressure is the same, and is also called "zone" below.

In the multi-burner system, when any burner is not normally ignited, the operation of all the burners in the combustion chamber is controlled to stop. Up to now, a condition (hereinafter referred to as "zone lockout condition") under which the operation of all the burners in the combustion chamber is stopped to cut off combustion in the combustion chamber is determined on the basis of required safety and stability of the multi-burner system.

For example, in the multi-burner system prioritizing safety, a situation in which even one of the multiple burners installed in the combustion chamber is not normally ignited is set as the zone lockout condition. On the other hand, in the multi-burner system where the stability is prioritized, in order to prevent an object that is being heated from being completely lost due to a reduction in temperature in the combustion furnace, a situation in which multiple burners among all the burners installed in the combustion chamber are not normally ignited is set as the zone lockout condition, and all cutoff in the combustion chamber is controlled to be avoided as much as possible. Incidentally, in the safety standards (e.g., safety general rules JIS B 8415 or the like of an industrial combustion furnace) for the industrial combustion furnaces, in the multi-burner system, if even one of the multiple burners installed in the common combustion chamber is combusted, the prepurge in the combustion chamber may not be implemented in igniting the other burners (the operation of all the burners may not be shut off).

As described above, in the conventional multi-burner system, the zone lockout condition is set for each zone, and the zone lockout condition is fixed. This suffers from the following problems.

For example, in the multi-burner system where the zone lockout condition under which the safety is prioritized as described above is set, even in a situation where the multiple burners are normally ignited, and a combustion state in the combustion chamber is not problematic, because the operation of all the burners is stopped when one burner is subjected to flame failure for some reason, there is an anxiety about the continuity of combustion, in other words, the stability of the combustion control.

On the other hand, in the multi-burner system where the zone lockout condition under which the stability is prioritized as described above is set, in performing ignition operation from a state in which all of the burners stop, because the operation is continued when the other burners are ignited even if one burner fails and is not ignited, there is an anxiety about the safety.

For the reasons described above, the combustion system high in the safety of combustion and the stability (continuity) of combustion has been desired.

An object of the present invention is to improve both of the safety and stability of combustion in a combustion control.

Means for Solving the Problems

A combustion controlling device (1A, 1B) according to the present invention that controls the operation of N (N is an integer of 2 or more) number of burners (21A to 24A, 21B to 24B), includes a determining portion (104) that determines combustion states of the N number of burners on the basis of a first shutoff condition (1031) for stopping the operation of the N number of burners at the time of an initial startup to ignite a desired burner from a state in which none of the burners is ignited, and a second shutoff condition (1032) for stopping the operation of the N number of burners in a normal operating state after the desired burner has been normally ignited by the initial startup; and an instruction portion (105) that generates an instruction for stopping the operation of the N number of burners on the basis of the determination result of the determining portion.

In the combustion controlling device, the first shutoff condition may be a condition for stopping the operation of the N number of burners when even one of the N number of burners is not ignited.

In the combustion controlling device, the second shutoff condition may be a condition for stopping the N number of burners when flames of M (M is an integer of N or less) number of burners among the N number of burners are not generated.

The combustion controlling device may further include: an operation mode setting portion (101) that sets any one of an initial startup mode for igniting the burners after performing prepurge and a normal operation mode for controlling the operation of the N number of burners in the normal operating state as an operation mode; and a shutoff condition selection unit (102) that selects the first shutoff condition when the initial startup mode is set by the operation mode setting portion, and selects the second shutoff condition when the normal operation mode is set by the operation mode setting portion, in which the determining portion may determine whether the combustion states of the N number of burners satisfy the condition selected by the shutoff condition selection unit, or not, and the instruction portion may generate the instruction for stopping all the operation of the N number of burners when it is determined by the determining portion that the combustion states of the N number of burners satisfy the selected condition, and may allow the operation of the N number of burners to be continued when it is determined by the determining portion that the combustion states of the N number of burners do not satisfy the selected condition.

In the combustion controlling device, the operation mode setting portion may switch the operation mode from the initial startup mode to the normal operation mode when a desired burner is normally ignited in the initial startup mode.

A combustion system includes: the combustion controlling device; a combustion furnace (2) having a combustion chamber (20A, 20B) in which the N number of burners are installed; and flame detectors (25A to 28A, 25B to 28B) that are installed for the respective burners, and detect the combustion states of the respective burners.

In the combustion system, the combustion furnace may include a plurality of the combustion chambers, a plurality of the combustion controlling devices may be disposed for the respective combustion chambers, and the respective combustion controlling devices may control the operation of the N number of burners installed in the respective combustion chambers.

In the above description, as an example, components on the drawings corresponding to components of the present invention are represented by reference numerals in parentheses.

Advantage of the Invention

As described above, according to the present invention, both of the safety and stability of the combustion can be improved in the combustion control.

MODE FOR CARRYING OUT THE INVENTION

Embodiments of the invention will be described below with reference to the drawings.

(Configuration of Combustion System)

Figure 1:
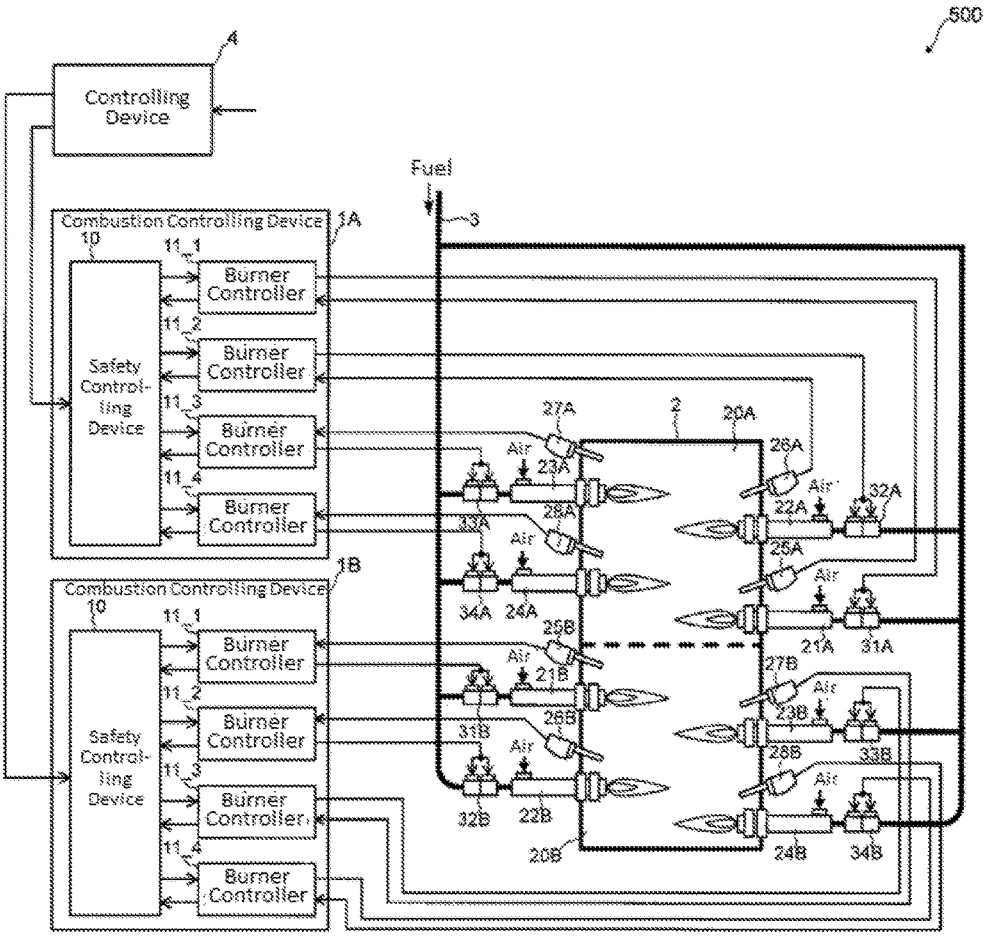
FIG. 1 is a diagram illustrating a configuration of a combustion system having a combustion controlling device according to the present embodiment.

FIG. 1 is a diagram illustrating a configuration of a combustion system having a combustion controlling device according to the present embodiment.

A combustion system 500 illustrated in the figure is a system that controls a combustion in a combustion furnace 2 for each of combustion chambers. The combustion system 500 can be exemplified by small industrial combustion furnaces such as a deodorizing furnace or a heating furnace, or large industrial combustion furnaces such as a steel furnace in a plant.

Specifically, the combustion system 500 includes a combustion furnace 2 having multiple combustion chambers 20A and 20B, combustion controlling devices 1A and 1B that are disposed for the respective combustion chambers, and control combustion in the respective combustion chambers, a controlling device 4 that controls the respective combustion controlling devices 1A and 1B, and a fuel flow channel 3 for supplying fuel (gas) to burners installed in the respective combustion chambers.

In the present specification, the combustion chamber (zone) means a space in which combustion is controlled under a condition (parameter) where a temperature or a pressure is the same as described above, and includes not only a structure in which the respective combustion chambers are physically separated from each other, but also a structure in which the respective combustion chambers are not physically separated from each other. For example, the combustion chambers 20A and 20B in the combustion furnace 2 may have a structure in which a part of a wall between the adjacent combustion chambers is opened so that an object (workpiece) to be heated can move between the multiple combustion chambers through a belt conveyer. In other words, the respective combustion chambers 20A and 20B may be configured by spaces in which a temperature, a pressure or the like can be controlled, individually, regardless of whether those combustion chambers are physically separated from each other, or not.

In the present embodiment, as an example, the combustion furnace 2 has a structure in which a part of the wall between the combustion chamber 20A and the combustion chamber 20B is opened, and the workpiece moves to the combustion chamber 20A and the combustion chamber 20B in the stated order by the belt conveyor, to thereby enable one workpiece to be subjected to multiple different heat treatments.

Further, the workpiece can be exemplified by an object to be processed such as a material such as iron or aluminum, steel to be carburized, a vehicle body as an object to be dried, or ceramic to be burned.

Each of the combustion chambers 20A and 20B is provided with N (N is an integer of 2 or more) number of burners, N number of flame detectors, and the other devices (for example, ignition devices (igniters), temperature sensors, etc.) required for the combustion control. For example, as illustrated in FIG. 1, the combustion chamber 20A is provided with four burners 21A to 24A and four flame detectors 25A to 28A, and the combustion chamber 20B is provided with four burners 21B to 24B and four flame detectors 25B to 28B. In FIG. 1, the other devices required for the combustion control such as the ignition devices and the temperature sensors will be omitted from illustration.

In the present embodiment, as described above, an example in which each of the combustion chambers 20A and 20B is provided with four (N=4) burners will be described. However, the number of burners installed in each of the combustion chambers 20A and 20B is not particularly restricted. For example, five burners may be installed in each of the combustion chambers 20A and 20B, or three burners may be installed in the combustion chamber 20A whereas two burners may be installed in the combustion chamber 20B.

The burners 21A to 24A are devices for heating the interior of the combustion chamber 20A, and the burners 21B to 24B are devices for heating the interior of the combustion chamber 20B. In the burners 21A to 24A and 21B to 24B, ignition is controlled for each burner. For example, the respective burners 21A to 24A and 21B to 24B are ignited by the ignition devices disposed in the respective burners 21A to 24A and 21B to 24B.

The flame detectors 25A to 28A and 25B to 28B are devices that are disposed in the respective burners 21A to 24A and 21B to 24B, and detect whether flames caused by the respective burners are present, or not. For example, the flame detector 25A detects whether the frame of the burner 21A is present, or not, and the flame detector 25B detects whether the frame of the burner 21B is present, or not. Detection results (flame detection signals) of whether the flames caused by the flame detectors 25A to 28A are present, or not, are input to the combustion controlling device 1A that will be described later, and detection results of whether the flames caused by the flame detectors 25B to 28B are present, or not, are input to the combustion controlling device 1B that will be described later.

The fuel flow channel 3 is a flow channel for supplying the fuel to the combustion furnace 2. The fuel flow channel 3 is branched into multiple flow channels from a main flow channel to which the fuel is supplied from the outside, and the branched flow channels are connected to the respective burners 21A to 24A and 21B to 24B. As a result, the fuel supplied to the fuel flow channel 3 from the outside is delivered to the respective burners 21A to 24A and burners 21B to 24B. The respective flow channels branched from the fuel flow channel 3 are provided with safety shutoff valves 31A to 34A and 31B to 34B for the respective burners 21A to 24A and 21B to 24B. For example, the valves of the burners 21A to 24A installed in the combustion chamber 20A are controlled to be opened or closed, for example, by the combustion controlling device 1A, and the valves of the burners 21B to 24B installed in the combustion chamber 20B are controlled to be opened or closed, for example, by the combustion controlling device 1B.

Although not shown, the combustion system 500 is provided with an air flow channel for supplying air to the combustion furnace 2 aside from the fuel flow channel 3, and the air discharged from blowers is supplied to the respective burners 21A to 24A and 21B to 24B through the air flow channel.

The controlling device 4 is a device on a higher level side in the combustion system 500, for performing a comprehensive control of the combustion furnace 2. The controlling device 4 gives the combustion controlling devices 1A and 1B an instruction (hereinafter referred to as "combustion request") for igniting the respective burners in the combustion chambers 20A and 20B, and a stop request for the operation of each of the combustion chambers 20A and 20B or the overall combustion furnace 2 according to an input operation from an operator (user) or the like.

The controlling device 4 may be a device for giving an instruction to the combustion controlling devices 1A and 1B according to the user's operation. For example, the controlling device 4 can be exemplified by a control panel in which a function portion (operation button or lever, keyboard, or the like) for entering the user's operation, and a function portion for outputting an instruction to a monitor and the combustion controlling devices 1A and 1B are integrated together. For example, when a network controlling system in which the combustion controlling devices 1A, 1B, the monitor, and a central management device are connected to each other through a network is structured, the function portion for giving the instruction to the combustion controlling devices 1A and 1B can configure the controlling device 4 as in the central management device.

The combustion controlling devices 1A and 1B (collectively referred to as "combustion controlling devices 1") are devices for controlling the combustion of the burners in the respective combustion chambers 20A and 20B according to the combustion request from the controlling device 4 or the operation stop request for the combustion chambers 20A and 20B (the overall combustion furnace 2). For example, the combustion controlling device 1A controls the combustion caused by the respective burners in the combustion chamber 20A, and the combustion controlling device 1B controls the combustion caused by the respective burners in the combustion chamber 20B.

The combustion controlling device 1 monitors the combustion states of the burners installed in the respective combustion chambers and states of the respective limit interlocks (not shown) to perform various controls for preventing explosion in the combustion chambers. For example, as one of the above controls, the combustion controlling device 1 performs a control (hereinafter also referred to as "zone lockout control") for stopping the operation of the N number of burners installed in the combustion chambers when the ignition states of the burners installed in the respective combustion chambers satisfy a predetermined condition. A detail of the zone lockout control will be described later.

(Configuration of Combustion Controlling Device)

A specific configuration of the combustion controlling device 1 will be described.

Meanwhile, because the combustion controlling device 1A and the combustion controlling device 1B have the same configuration, in the present specification, the combustion controlling device 1A will be typically described in detail, and a detailed description of the combustion controlling device 1B will be omitted.

As illustrated in FIG. 1, the combustion controlling device 1A includes burner controllers 11_1 to 11_4 and a safety controlling device 10.

The burner controllers 11_1 to 11_4 (collectively referred to as "burner controllers 11") are devices that are disposed for the respective burners, and control the operation of the respective burners to control the combustion in the combustion chamber. Specifically, the burner controllers 11 control the open/close operation of the respective safety shutoff valves 31A to 34A and the startup of the ignition devices (not shown) on the basis of an instruction from the safety controlling device 10 that will be described later, and flame detection signals from the flame detectors 25A to 28A, to thereby ignite the respective burners 21A to 24A according to a set ignition sequence. For example, the burner controller 11_1 controls the open/close operation of the safety shutoff valve 31A and the startup of the corresponding ignition device (not shown) on the basis of the instruction from the safety controlling device 10 and the flame detection signal from the flame detector 25A, to thereby control the ignition of the burner 21A.

The burner controllers 11 ignites the respective burners on the basis of the instruction from the safety controlling device 10, and generates the flame determination information indicative of whether stable flames are generated from the burners, or not, on the basis of the flame detection signals from the respective flame detectors to output the flame determination information to the safety controlling device 10.

When abnormality such as a misfire or a flame failure is generated in any burner, the burner controllers 11 lock out that burner. In that case, for example, the burner controllers 11 outputs abnormality detection information indicative of a fact that the burner is locked out to the safety controlling device 10 with the results that the safety controlling device 10 detects that the burner is locked out, and notifies the controlling device 4 of this fact.

The safety controlling device 10 is a device that performs the safe operation of the combustion system 500, in other words, monitors combustion states of the respective burners and states of the respective limit interlocks (not shown) in order to prevent the explosion in the combustion furnace 2, to thereby perform the safety control for instructing the respective burner controllers to allow or disallow the operation of the respective burners in the combustion chamber. Specifically, the safety controlling device 10 generates signals indicative of the permission or non-permission of the operation of the respective burners on the basis of the combustion request or the cutoff request for the burners from the controlling device 4, and the flame determination information and the abnormality detection information input from the respective burner controllers 11_1 to 11_4, and gives the generated signals to the respective burner controllers 11_1 to 11_4, to thereby control the operation (the supply and stop of fuel to the respective burners) of the burners 21A to 24A through the respective burner controllers 11.

The safety controlling device 10 can be exemplified by a limit interlock module for monitoring a limit interlock manufactured on the basis of safety rules (for example, safety general rules of the industrial combustion furnace JIS B 8415, etc.) related to the industrial combustion furnaces, or a programmable logic controller (so-called safety PLC) that configures a dedicated software complying with the safety general rules.

The safety controlling device 10 performs the above-mentioned zone lockout control as one of the safety control.

In this example, the safety controlling device 10 has, as zone lockout conditions used for the zone lockout control, a zone lockout condition (first shutoff condition) at the time of a startup (hereinafter referred to as "initial startup") for igniting a desired burner from a state in which none of the burners is ignited, and a zone lockout condition (second shutoff condition) in an operating state (hereinafter referred to as "normal operating state") after the desired burner is normally ignited by the initial startup, and can execute the zone lockout according to the different zone lockout conditions during the initial startup and the normal operating state. The zone lockout control by the safety controlling device 10 will be described in detail.

(Configuration of Safety Controlling Device)

Figure 2:
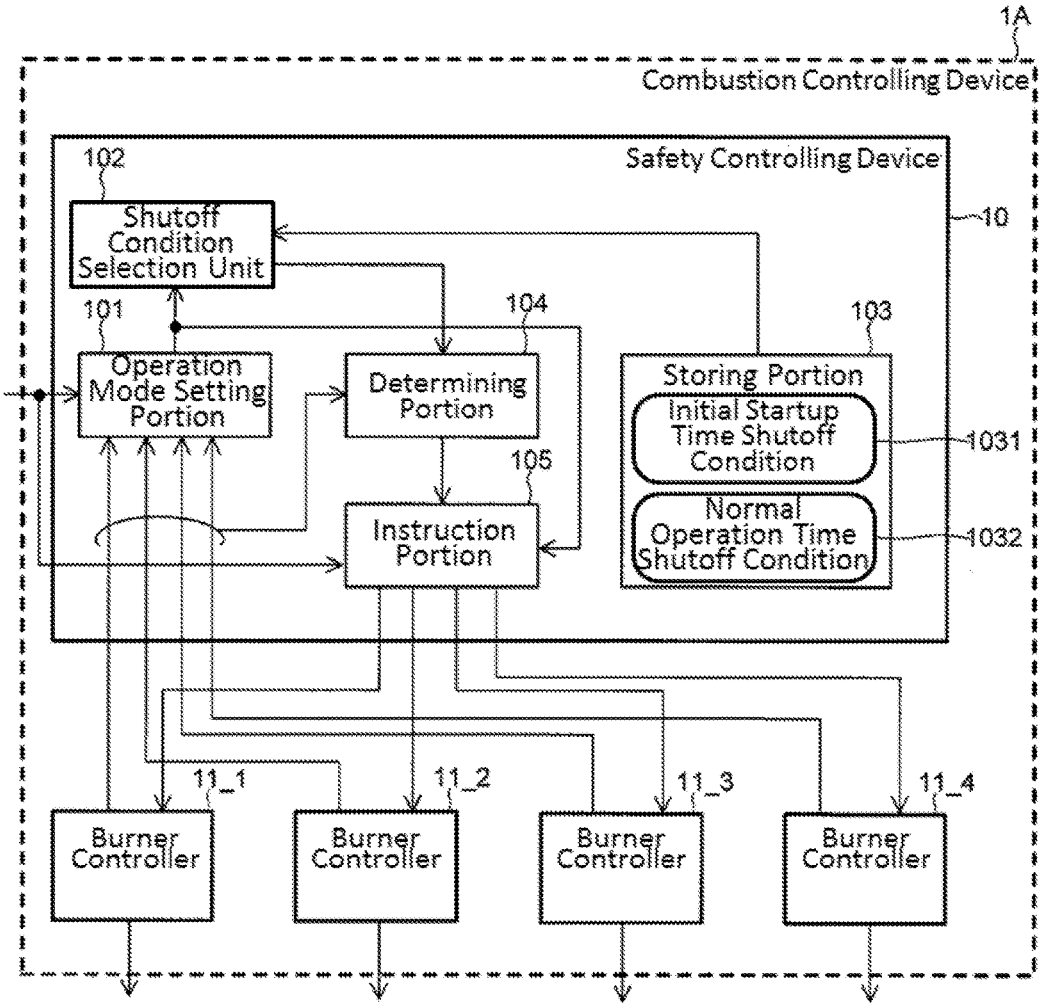
FIG. 2 is a diagram illustrating a configuration of a safety controlling device in the combustion controlling device according to the embodiment.

FIG. 2 is a diagram illustrating a configuration of the safety controlling device 10 in the combustion controlling device according to the embodiment. In the drawing, only the function portions for performing the zone lockout control in the safety controlling device 10 are illustrated, and the other function portions (for example, function portions for monitoring a limit or an interlock, etc.) are omitted from illustration.

Although not shown, the safety controlling device 10 and the burner controllers 11 are equipped with external terminals for transmitting and receiving signals with respect to the external devices (the safety shutoff valves 31A to 34A and the flame detectors 25A to 28A), and external interfaces such as an input circuit and an output circuit.

As illustrated in FIG. 2, the safety controlling device 10 has, as the function portions for performing the zone lockout control, an operation mode setting portion 101, a shutoff condition selection unit 102, a storing portion 103, a determining portion 104, and an instruction portion 105. For example, those function portions are realized by a processor such as a CPU, various memories, and a microcontroller (MCU) configured by the other peripheral circuits. In other words, the processor in the MCU executes a variety of data processing according to a program stored in the memory to realize the operation mode setting portion 101, the shutoff condition selection unit 102, the storing portion 103, the determining portion 104, and the instruction portion 105.

The operation mode setting portion 101 is a function portion that sets the operation mode of the burners in the respective combustion chambers. Specifically, the operation mode setting portion 101 sets any one of the initial startup mode and the normal operation mode as the operation mode on the basis of the flame determination information and the abnormality detection information supplied from the respective burner controllers 11_1 to 11_4 or the combustion request from the controlling device 4.

In this example, the initial startup mode is an operation mode for igniting a desired burner after performing prepurge (zone prepurge). The normal operation mode means an operation mode for controlling the operation of the N number of burners in the normal operating state.

The desired burner means a burner to be ignited during the initial startup, which are, for example, one burner to be initially ignited in the case of a sequential startup to be described later, and all of the burners to be ignited at the same time in the case of a simultaneous startup to be described later.

For example, the operation mode setting portion 101 sets the operation mode to "the initial startup mode" when none of the burners is ignited. For example, the operation mode setting portion 101 sets the operation mode to "initial startup mode" during the initial operation immediately after the combustion system 500 has started, in the case where the combustion request for all of the burners from the controlling device 4 is absent, and in the case where the zone lockout is executed (or the zone lockout is canceled (reset)).

On the other hand, the operation mode setting portion 101 switches the operation mode from "the initial startup mode" to "the normal operation mode" when a desired burner is normally ignited in the initial startup mode (when all of the burners to be ignited simultaneously are ignited in the simultaneous startup which will be described later, or when a burner first subjected to the combustion request is ignited in the sequential startup which will be described later). Specifically, the operation mode setting portion 101 switches the operation mode from "the initial startup mode"

to "the normal operation mode" when the flame determination information from the burner controllers 11 corresponding to the burner whose ignition is instructed in the initial startup mode indicates "that stable flame is generated".

The shutoff condition selection unit 102 selects the zone lockout condition corresponding to the operation mode selected by the operation mode setting portion 101. Specifically, when the initial startup mode is selected by the operation mode setting portion 101, the shutoff condition selection unit 102 selects an initial startup time shutoff condition as the first shutoff condition. On the other hand, when the normal operation mode is selected by the operation mode setting portion 101, the shutoff condition selection unit 102 selects the normal operation time shutoff condition as the second shutoff condition.

The information on the above zone lockout conditions, that is, an initial startup time shutoff condition 1031 and a normal operation time shutoff condition 1032 are stored in the storing portion 103. The shutoff condition selection unit 102 reads the information on the zone lockout condition corresponding to the operation mode selected by the operation mode setting portion 101 from the storing portion 103 to determine the zone lockout condition.

In this example, the initial startup time shutoff condition 1031 is a zone lockout condition for stopping the operation of the N number of burners at the time of the initial startup. Specifically, the initial startup time shutoff condition 1031 is a condition for stopping the operation of the N number of burners when even one of the N number of burners is not ignited. For example, the initial startup time shutoff condition 1031 is a condition for stopping the operation of the four burners 21A to 24A in the combustion chamber 20A when any one of the four (N=4) burners 21A to 24A in the combustion chamber 20A is not ignited at the time of the initial startup.

The normal operation time shutoff condition 1032 is a zone lockout condition for stopping the operation of the N number of burners in the normal operating state. Specifically, the normal operation time shutoff condition 1032 is a condition for stopping the operation of the N number of burners in the normal operating state when the flames of M (M is an integer of N or less) number of burners among the N number of burners are not generated.

In this example, a value of "M" in the normal operation time shutoff condition 1032 can be arbitrary set in a range of $M \leq N$ according to the type of the combustion system 500 or a request from the user who uses the combustion system 500. For example, the normal operation time shutoff condition 1032 can be differentiated from the initial startup time shutoff condition 1031 as a condition for stopping the operation of all the burners 21A to 24A in the combustion chamber 20A when two (M=2) or more burners among the four (N=4) burners 21A to 24A in the combustion chamber 20A are subjected to flame failure.

A burner to be determined in the initial startup time shutoff condition 1031 and the normal operation time shutoff condition 1032 may be a main burner for heating the combustion chamber or a pilot burner for igniting the main burner. For example, in the case of a direct ignition system that ignites the main burner directly without the provision of the pilot burner, the burner to be determined is the main burner. On the other hand, in the case of a general timed pilot that ignites the main burner after igniting the pilot burner, the burner to be determined may be, for example, a pilot burner.

The information on the initial startup time shutoff condition 1031 and the normal operation time shutoff condition 1032 is written in a nonvolatile memory such as a flash memory, for example, at the time of the production or shipment of the combustion controlling device 1, and expanded in a RAM in the MPU from the nonvolatile memory so as to be stored in the storing portion 103 at the time of starting the combustion controlling device 1.

The determining portion 104 is a function portion that determines whether the combustion states caused by the N number of burners satisfy the zone lockout condition selected by the shutoff condition selection unit 102, or not. Specifically, the determining portion 104 determines whether the combustion states caused by the respective burners 21A to 24A satisfy the zone lockout condition (the initial startup time shutoff condition or the normal operation time shutoff condition) selected by the shutoff condition selection unit 102, or not, on the basis of the flame determination information output from the respective burner controllers 11_1 to 11_4.

The instruction portion 105 is a function portion that instructs the respective burner controllers 11_1 to 11_4 whether to permit the operation of the respective burners 21A to 24A, or not. Specifically, when it is determined by the determining portion 104 that the combustion states caused by the N number of burners satisfy the zone lockout condition (abnormal state), the instruction portion 105 instructs the respective burner controllers 11_1 to 11_4 to stop the operation of the N number of burners (zone lockout), and when it is determined by the determining portion 104 that the combustion states caused by the N number of burners do not satisfy the zone lockout condition (normal state), the instruction portion 105 instructs the respective burner controllers 11_1 to 11_4 to permit the continuation of the operation of the N number of burners.

The operation of the combustion system 500 under the zone lockout control will be described with reference to timing charts of FIGS. 3 to 7.

In general, in the multi-burner system like the combustion system 500, two types of techniques including "sequential startup" for sequentially igniting the respective burners in the combustion chamber and "simultaneous startup" for igniting the respective burners in the combustion chamber, simultaneously, have been known as ignition techniques during the initial startup. As an example, the zone lockout control in the above respective ignition techniques will be described.

In the following description, it is assumed that a condition for stopping the operation of the four burners 21A to 24A in the combustion chamber 20A is set as the normal operation time shutoff condition 1032 when any three (M=3) burners among four (N=4) burners 21A to 24A in the combustion chamber 20A are subjected to flame failure.

First, the zone lockout control when the burners are not normally ignited during the sequential startup will be described.

Figure 3:
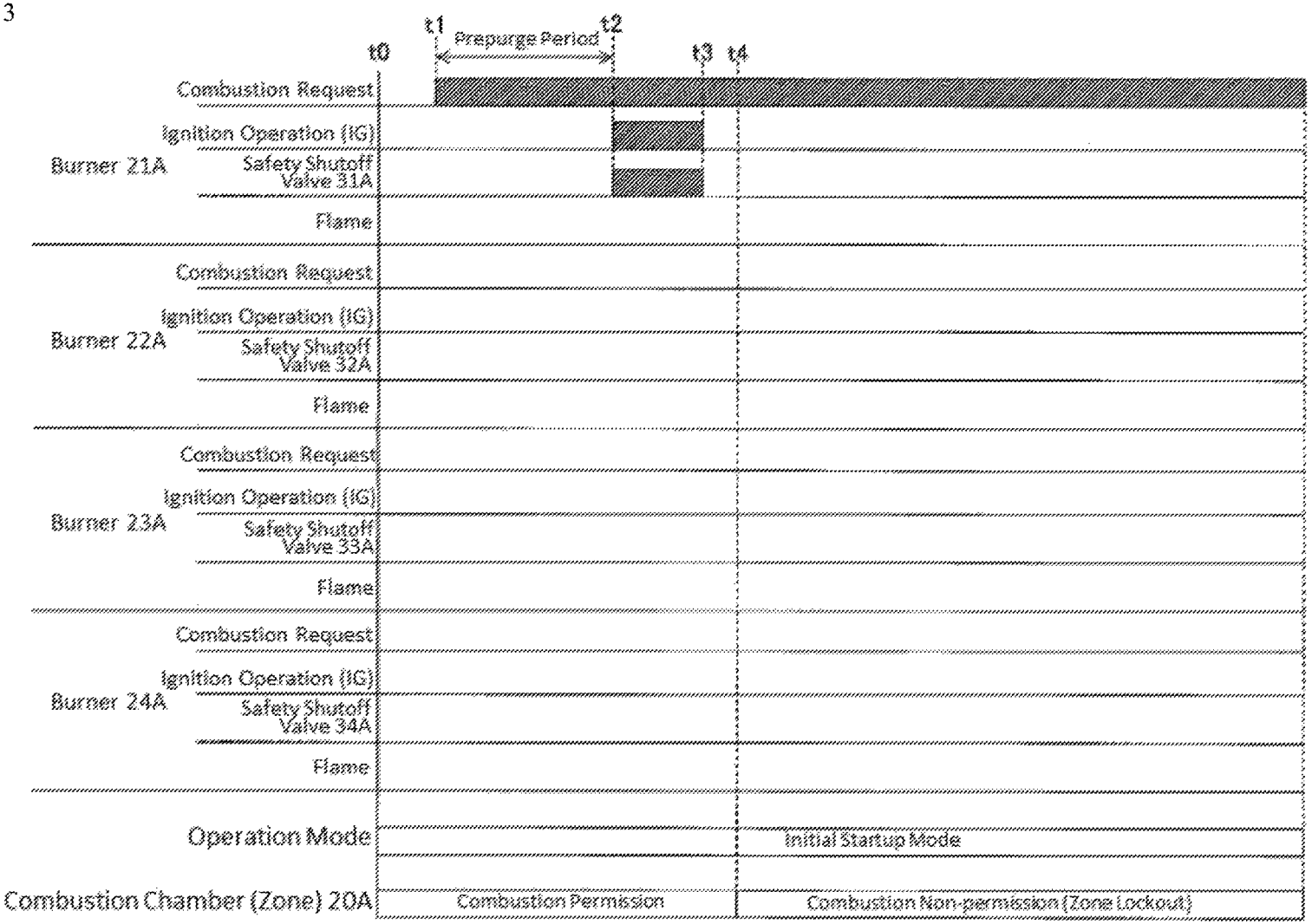
FIG. 3 is a timing chart for illustrating a zone lockout control during a sequential startup by the combustion controlling device according to the embodiment.

FIG. 3 is a timing chart for illustrating a zone lockout control during a sequential startup by the combustion controlling device according to the embodiment.

FIG. 3 illustrates the respective timings of the presence or absence of the combustion request for the respective burner 21A to 24A, the presence or absence of the ignition operation for the burner 21A to 24A, an open or closed state of the safety shutoff valves 31A to 34A, and the presence or absence of flames of the respective burner 21A to 24A, in the stated order of the burner 21A, 22A, 23A, and 24A from a top. At the lower stages of the timing of the respective burner 21A to 24A, the operation mode, and the presence or absence of the zone lockout in the combustion chamber 20A are illustrated. In FIG. 3, a period during which the combustion request is output, an ignition period (ignition trial period) during which the ignition operation is performed, a period during which the safety shutoff valves 31A to 34A are opened, and a period during which the flame is generated are hatched. Those various pieces of information in FIG. 3 are the same as that in FIGS. 4 to 7 which will be described later.

As illustrated in FIG. 3, for example, when the combustion system 500 starts at a time t0, the operation mode setting portion 101 selects "the initial startup mode", and the shutoff condition selection unit 102 selects the initial startup time shutoff condition 1031 in response to the selection. Thereafter, the controlling device 4 outputs the ignition instruction for the combustion chamber 20A to the combustion controlling device 1A according to an ignition sequence of the sequential startup. Specifically, for example, at a time t1, the controlling device 4 outputs the combustion request for the burner 21A. The safety controlling device 10 of the combustion controlling device 1A that has received the combustion request first starts the prepurge in the combustion chamber 20A. After a predetermined prepurge period has elapsed, the safety controlling portion 10 in the combustion controlling device 1A instructs the burner controller 11_1 to ignite the burner 21A, to thereby start the ignition operation of the burner 21A. In this situation, the burner controller 11_1 opens the safety shutoff valve 31A to supply the fuel to the burner 21A. In this example, it is assumed that the burner 21A is not ignited.

After the ignition period of the burner 21A has elapsed, the burner controller 11_1 is locked out, and outputs the flame determination information indicating that no flame is generated to the safety controlling device 10. The safety controlling device 10 that has received the flame determination information determines that the combustion states of the burners in the combustion chamber 20A have satisfied the initial startup time shutoff condition 1031 (abnormal) by the determining portion 104, and instructs the respective burner controllers 11_1 to 11_4 to stop the operation of the burners by the instruction portion 105 (instruction for the zone lockout). As a result, for example, at a time t4, the respective burners 21A to 24A stop, and the combustion chamber 20A is subjected to zone lockout.

Subsequently, the zone lockout control when the burners are normally ignited during the sequential startup will be described.

Figure 4:
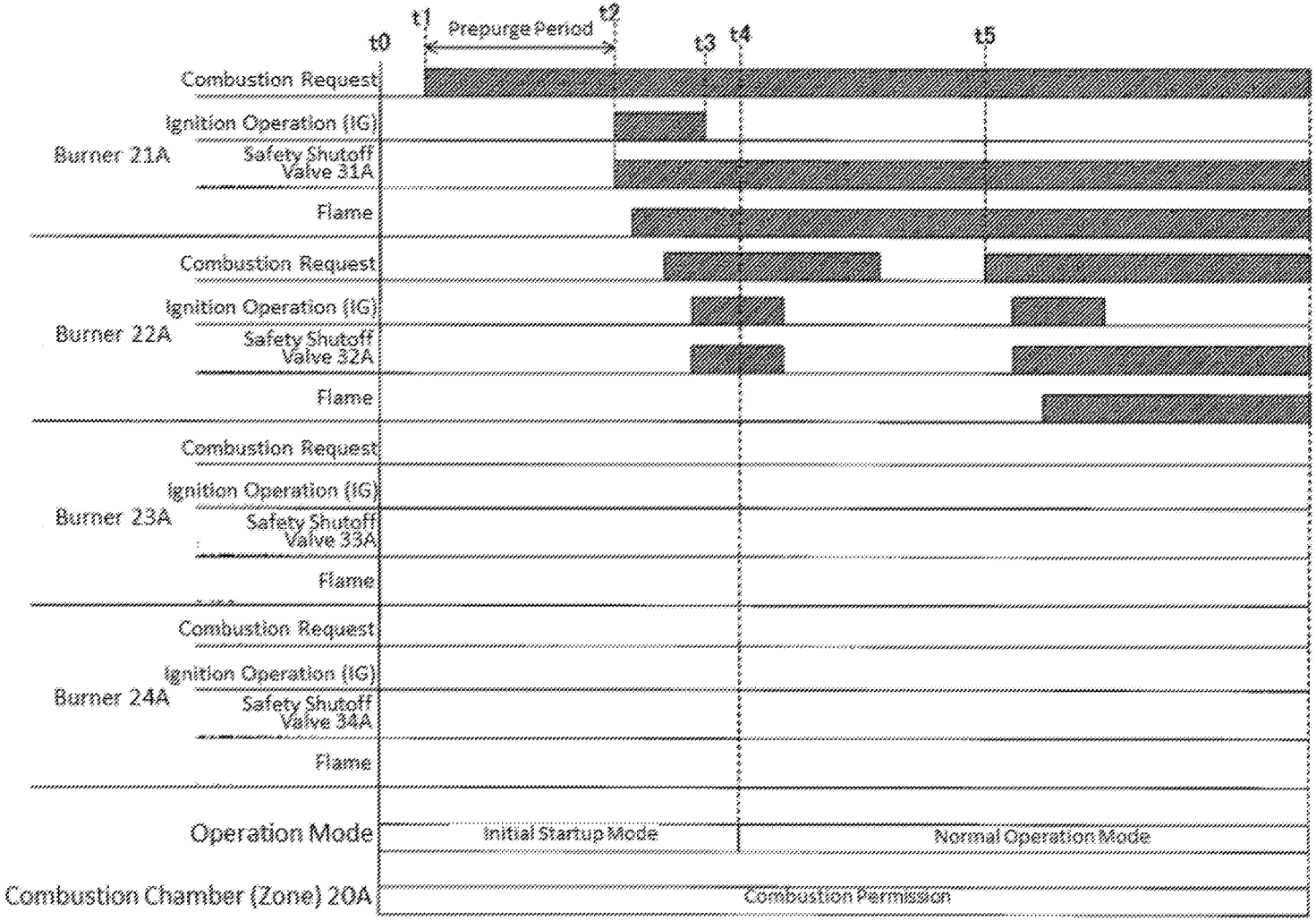
FIG. 4 is another timing chart for illustrating the zone lockout control during the sequential startup by the combustion controlling device according to the embodiment.

FIG. 4 is another timing chart for illustrating the zone lockout control during the sequential startup by the combustion controlling device according to the embodiment.

As illustrated in FIG. 4, the processing is performed in the same procedure as that in FIG. 3 till a time t2 at which the prepurge is completed after the combustion system 500 starts up at a time t0.

At the time t2, upon the completion of the prepurge, the safety controlling device 10 in the combustion controlling device 1A instructs the burner controller 11_1 to ignite the burner 21A, to thereby start the ignition operation of the burner 21A. In this situation, the burner controller 11_1 opens the safety shutoff valve 31A to supply the fuel to the burner 21A. In this example, it is assumed that the burner 21A is ignited, and the flame is stabilized.

Continuously, for example, at a time t3, when the controlling device 4 outputs the combustion request for the burner 22A, the safety controlling device 10 instructs the burner controller 11_2 to ignite the burner 22A, to thereby start the ignition operation of the burner 22A.

After the ignition period of the burner 21A has elapsed, the burner controller 11_1 outputs the flame determination information indicating that the flame has been generated to the safety controlling device 10. The safety controlling device 10 that has received the flame determination information determines that the combustion states of the burners in the combustion chamber 20A do not satisfy the initial startup time shutoff condition 1031 (normal) by the determining portion 104, and permits the respective burner controllers 11_1 to 11_4 to operate the burners.

The safety controlling device 10 determines that one burner has been normally ignited (has not satisfied the initial startup time shutoff condition 1031) at the time of initial startup by the operation mode setting portion 101, and for example, at the time t4, switches the operation mode from "the initial startup mode" to "the normal operation mode". Along with this switching, the safety controlling device 10 switches the zone lockout condition from the initial startup time shutoff condition 1031 to the normal operation time shutoff condition 1032 by the shutoff condition selection unit 102.

In that case, when it is assumed that, for example, the burner 22A has not been normally ignited, after the ignition period of the burner 22A has elapsed, the burner controller 11_2 outputs the flame determination information indicating that the flame has not been generated to the safety controlling device 10. The safety controlling device 10 that has received the flame determination information determines that the combustion states of the burners in the combustion chamber 20A do not satisfy the normal operation time shutoff condition 1032 (normal) by the determining portion 104, and permits the respective burner controllers 11_1 to 11_4 to continue the operation of the burners. In other words, in this case, the combustion of the burner 21A is continued.

Thereafter, the safety controlling device 10 notifies the controlling device 4 that the burner 22A has not been ignited. When the controlling device 4 that has received this notification receives an instruction for reignition of the burner 22A, for example, from the user, the safety controlling device 10 outputs the combustion request of the burner 22A to the combustion controlling device 1A, for example, at a time t5. The safety controlling device 10 in the combustion controlling device 1A that has received the combustion request instructs the burner controller 11_2 to ignite the burner 22A, to thereby again start the ignition operation of the burner 22A.

Subsequently, the zone lockout control when the burners are not normally ignited during the simultaneous startup will be described.

Figure 5:
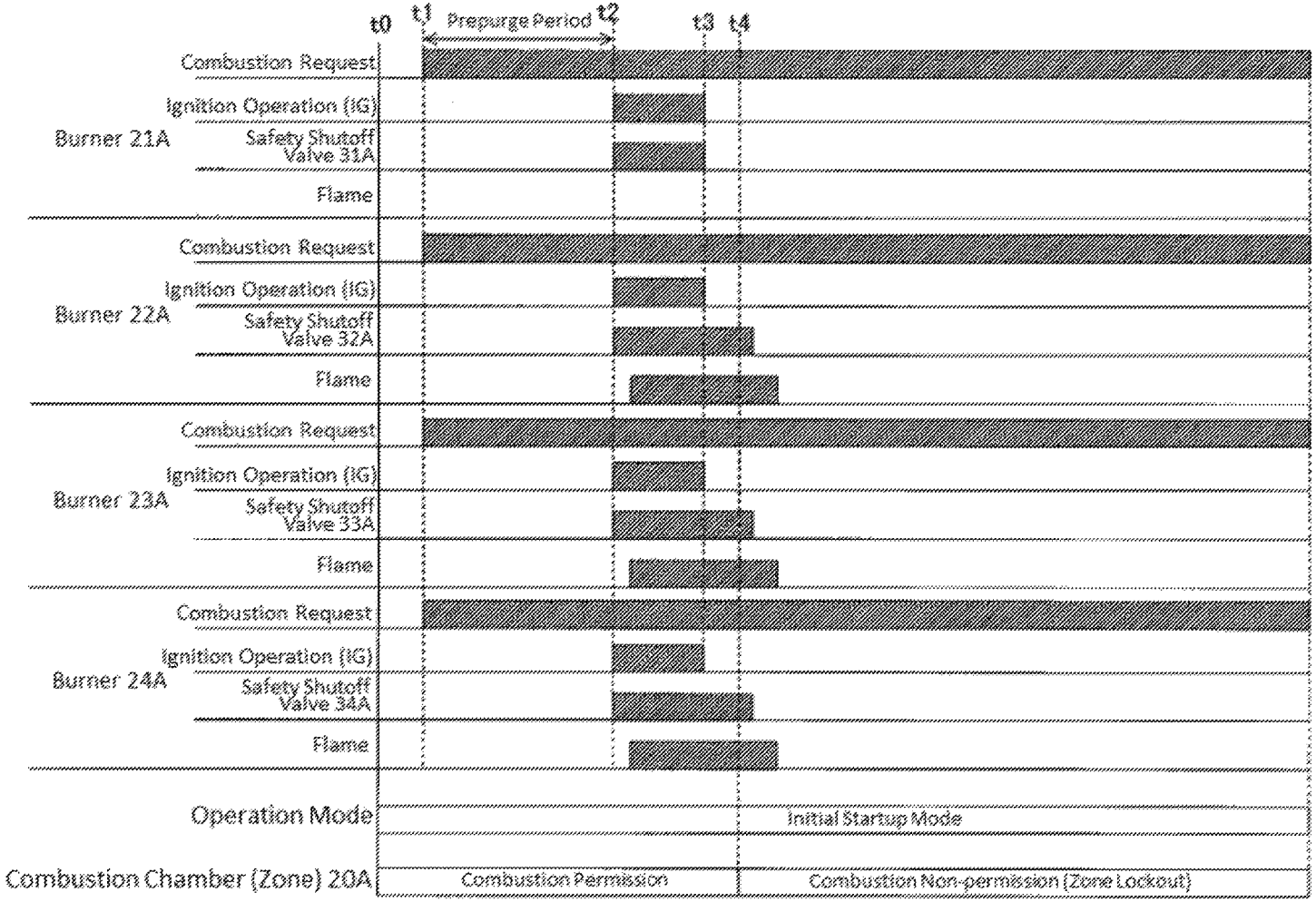
FIG. 5 is a timing chart for illustrating a zone lockout control during a simultaneous startup by the combustion controlling device according to the embodiment.

FIG. 5 is a timing chart for illustrating a zone lockout control during a simultaneous startup by the combustion controlling device according to the embodiment.

As illustrated in FIG. 5, for example, when the combustion system 500 starts, for example, at the time t0, "the initial startup mode" is selected by the operation mode setting portion 101, and the initial startup time shutoff condition 1031 is selected by the shutoff condition selection unit 102, as in the case of FIGS. 3 and 4. Thereafter, the controlling device 4 outputs the ignition instruction for the combustion chamber 20A to the combustion controlling device 1A according to an ignition sequence of the simultaneous startup. Specifically, for example, at the time t1, the controlling device 4 outputs the combustion request for the burners 21A to 24A. The safety controlling device 10 of the combustion controlling device 1A that has received the combustion request first starts the prepurge in the combustion chamber 20A.

After a predetermined prepurge period has elapsed, the safety controlling device 10 in the combustion controlling device 1A instructs the respective burner controllers 11_1 to 11_4 to ignite the burners 21A to 24A, to thereby start the ignition operation of the respective burners 21A to 24A. In this situation, the burner controllers 11_1 to 11_4 open the respective safety shutoff valves 31A to 34A, to thereby supply the fuel to the respective burners 21A to 24A.

In this example, as illustrated in FIG. 5, it is assumed that three burners 22A to 24A among the four burners in the combustion chamber are ignited, but the remaining one burner 21A is not ignited.

In that case, after the ignition period has elapsed, the burner controllers 11_2 to 11_4 corresponding to the ignited three burners 22A to 24A output the flame determination information indicating that the flame has been generated to the safety controlling device 10. On the other hand, after the ignition period has elapsed, the burner controller 11_1 corresponding to the ignited burner 21A determines that no flame is generated, is locked out, and outputs the flame determination information indicating that no flame is generated to the safety controlling device 10.

The safety controlling device 10 that has received the flame determination information from the respective burner controllers 11_1 to 11_4 determines that the combustion states of the burners in the combustion chamber 20A have satisfied the initial startup time shutoff condition 1031 (abnormal) by the determining portion 104, and instructs the respective burner controllers 11_1 to 11_4 to stop the operation of the burners by the instruction portion 105 (instruction for the zone lockout). As a result, for example, at the time t4, the respective burners 21A to 24A stop, and the combustion chamber 20A is subjected to zone lockout.

Subsequently, the zone lockout control when the burners are normally ignited during the simultaneous startup will be described.

Figure 6:
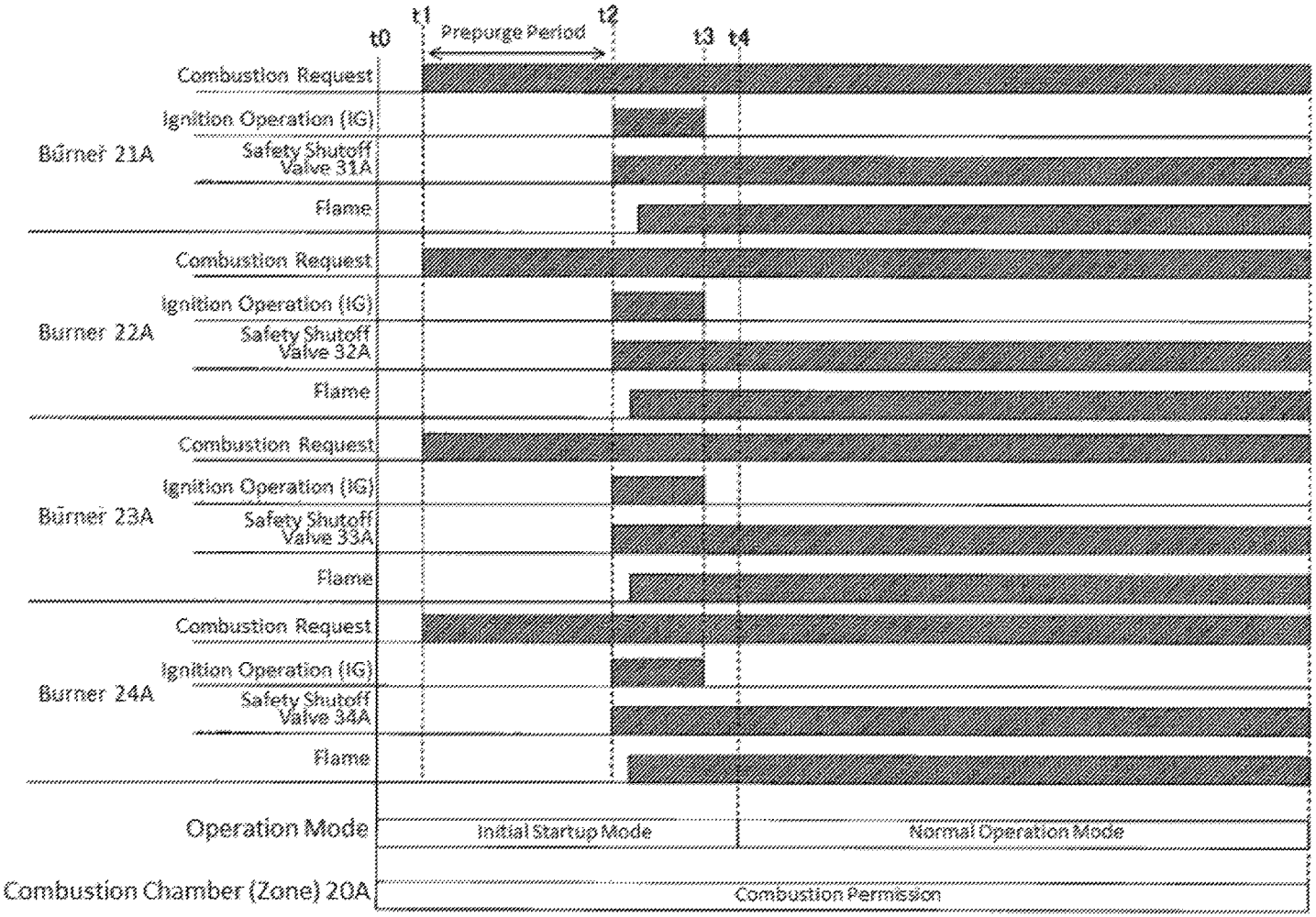
FIG. 6 is another timing chart for illustrating the zone lockout control during the simultaneous startup by the combustion controlling device according to the embodiment.

FIG. 6 is another timing chart for illustrating the zone lockout control during the simultaneous startup by the combustion controlling device according to the embodiment.

As illustrated in FIG. 6, the processing is performed in the same procedure as that in FIG. 5 till the time t2 at which the prepurge is completed, and the ignition operation of the respective burners 21A to 24A starts, after the combustion system 500 starts up at the time t0.

In this example, as illustrated in FIG. 6, it is assumed that all of the burners 21A to 24A in the combustion chamber 20A are ignited. In that case, after the ignition period has elapsed, the burner controllers 11_1 to 11_4 corresponding to the respective ignited burners 21A to 24A output the flame determination information indicating that the flame has been generated to the safety controlling device 10.

The safety controlling device 10 that has received the flame determination information from the respective burner controllers 11_1 to 11_4 determines that the combustion states of the respective burners in the combustion chamber 20A do not satisfy the initial shutoff condition 1031 (normal) by the determining portion 104, and permits the respective burner controllers 11_1 to 11_4 to operate the burners.

The safety controlling device 10 determines that a desired burner has been normally ignited at the time of initial startup (has not satisfied the initial startup time shutoff condition) by the operation mode setting portion 101, and for example, at the time t4, switches the operation mode from "the initial startup mode" to "the normal operation mode". Along with this switching, the safety controlling device 10 switches the zone lockout condition from the initial startup time shutoff condition 1031 to the normal operation time shutoff condition 1032 by the shutoff condition selection unit 102. Thereafter, the combustion by the respective burners 21A to 24A is continued.

Subsequently, the zone lockout control when the burners are subjected to flame failure in the normal operation mode will be described.

Figure 7:
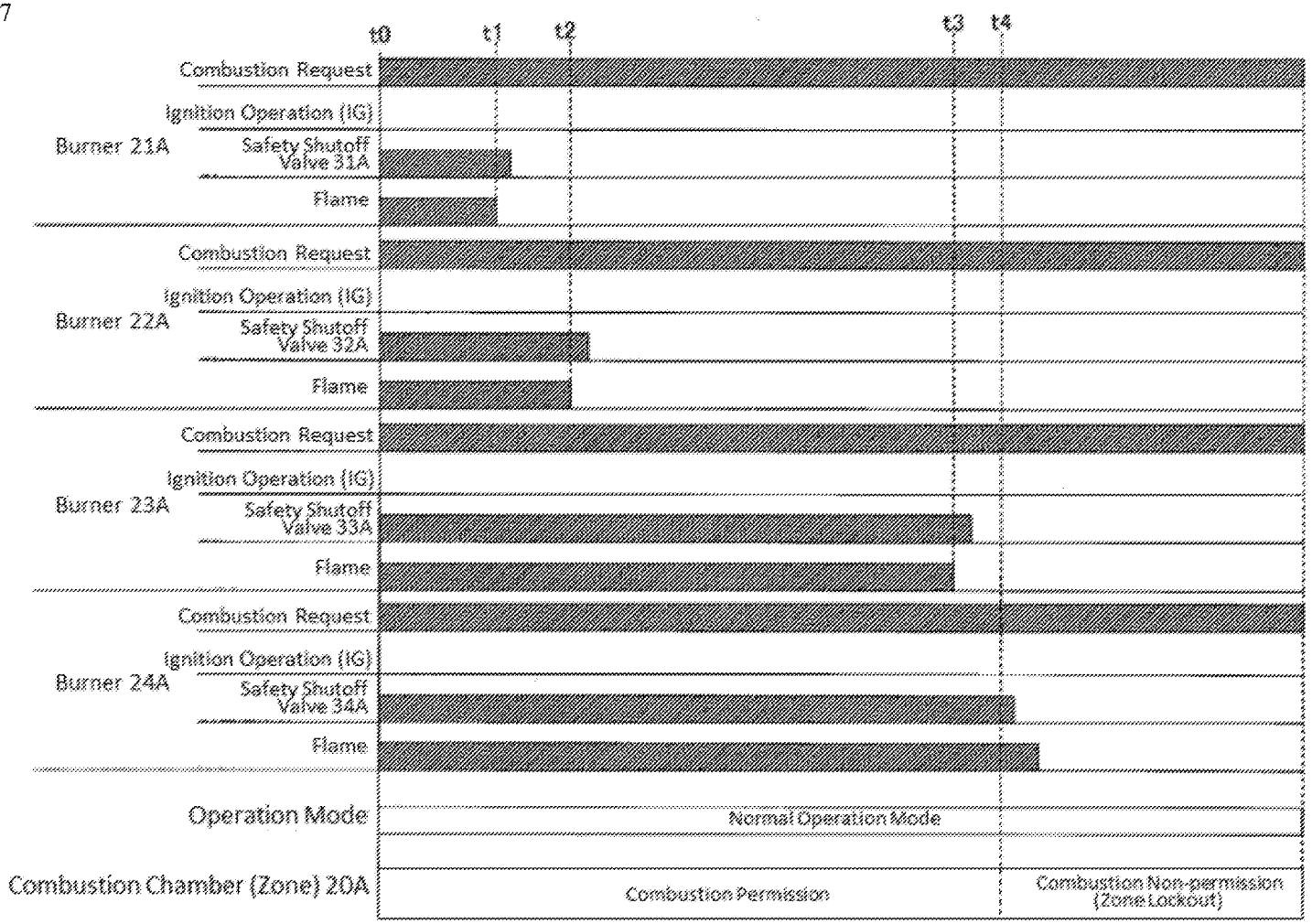
FIG. 7 is a timing chart for illustrating a zone lockout control in a normal operation mode by the combustion controlling device according to the embodiment.

FIG. 7 is a timing chart for illustrating a zone lockout control in the normal operation mode by the combustion controlling device according to the embodiment.

As illustrated in FIG. 7, it is assumed that normal combustion is performed in the normal operation mode (normal operation time shutoff condition) in the combustion chamber 20A, for example, at the time t0. In that case, it is assumed that, for example, for some reason, the burner 21A is subjected to the flame failure, for example, at the time t1, the burner 22A is subjected to the flame failure at the time t2, and the burner 23A is subjected to the flame failure at the time t3.

First, when the burner 21A is subjected to the flame failure at the time t1, the burner controller 11_1 closes the corresponding safety shutoff valve 31A, locks out the burner 21A, and outputs the abnormality detection information indicating that the burner 21A is locked out and the flame determination information indicating that no flame is generated by the burner 21A to the safety controlling device 10. The safety controlling device 10 that has received the flame determination information determines whether the combustion states of the respective burners satisfy the normal operation time shutoff condition 1032, or not, by the determining portion 104. At the time t1, because only the burner 21A among the four burners is subjected to flame failure, and the remaining three burners 22A to 24A are normally combusted, the safety controlling device 10 determines that the combustion states of the respective burners do not satisfy the normal operation time shutoff condition 1032 (normal) by the determining portion 104, and permits the operation of the remaining three burners 22A to 24A.

Then, when the burner 22A is subjected to the flame failure at the time t2, the burner controller 11_2 closes the corresponding safety shutoff valve 32A, locks out the burner 22A, and outputs the abnormality detection information indicating that the burner 22A is locked out and the flame determination information indicating that no flame is generated by the burner 22A to the safety controlling device 10. The safety controlling device 10 that has received the flame determination information determines whether the combustion states of the respective burners satisfy the normal operation time shutoff condition 1032, or not, by the determining portion 104. At the time t2, because only the burners 21A and 22A among the four burners is subjected to flame failure, and the remaining two burners 23A and 24A are normally combusted, the safety controlling device 10 determines that the combustion states of the respective burners do not satisfy the normal operation time shutoff condition 1032 (normal) by the determining portion 104, and permits the operation of the remaining two burners 23A and 24A.

Thereafter, when the burner 23A is further subjected to the flame failure at the time t3, the burner controller 11_3 closes the corresponding safety shutoff valve 33A, locks out the burner 23A, and outputs the abnormality detection information indicating that the burner 23A is locked out and the flame determination information indicating that no flame is generated by the burner 23A to the safety controlling device 10. The safety controlling device 10 that has received the flame determination information determines whether the combustion states of the respective burners satisfy the normal operation time shutoff condition 1032, or not, by the determining portion 104. At the time t3, because three burners 21A to 23A among the four burners are subjected to flame failure, the safety controlling device 10 determines that the combustion states of the respective burners satisfy the normal operation time shutoff condition 1032 (abnormal) by the determining portion 104, and stops the operation of all the burners including the burner 24A that normally operates in the combustion chamber 20A, for example, at the time t4 (zone lockout).

Meanwhile, in the switching of the operation mode from "the normal operation mode" to "the initial startup mode", "the initial startup mode" may be set at the time of next initial startup, and switching timing is not particularly restricted. For example, the determining portion 104 (or the operation mode setting portion 101) may switch the operation mode to "the initial startup mode" when determining that three of the four burners are subjected to flame failure (the normal operation time shutoff condition 1032 is satisfied) in the normal operation mode, or may switch the operation mode to "the initial startup mode" when the zone lockout is cancelled (reset) through the controlling device 4.

Finally, a flow of the zone lockout control by the combustion controlling device 1 will be described.

Figure 8:
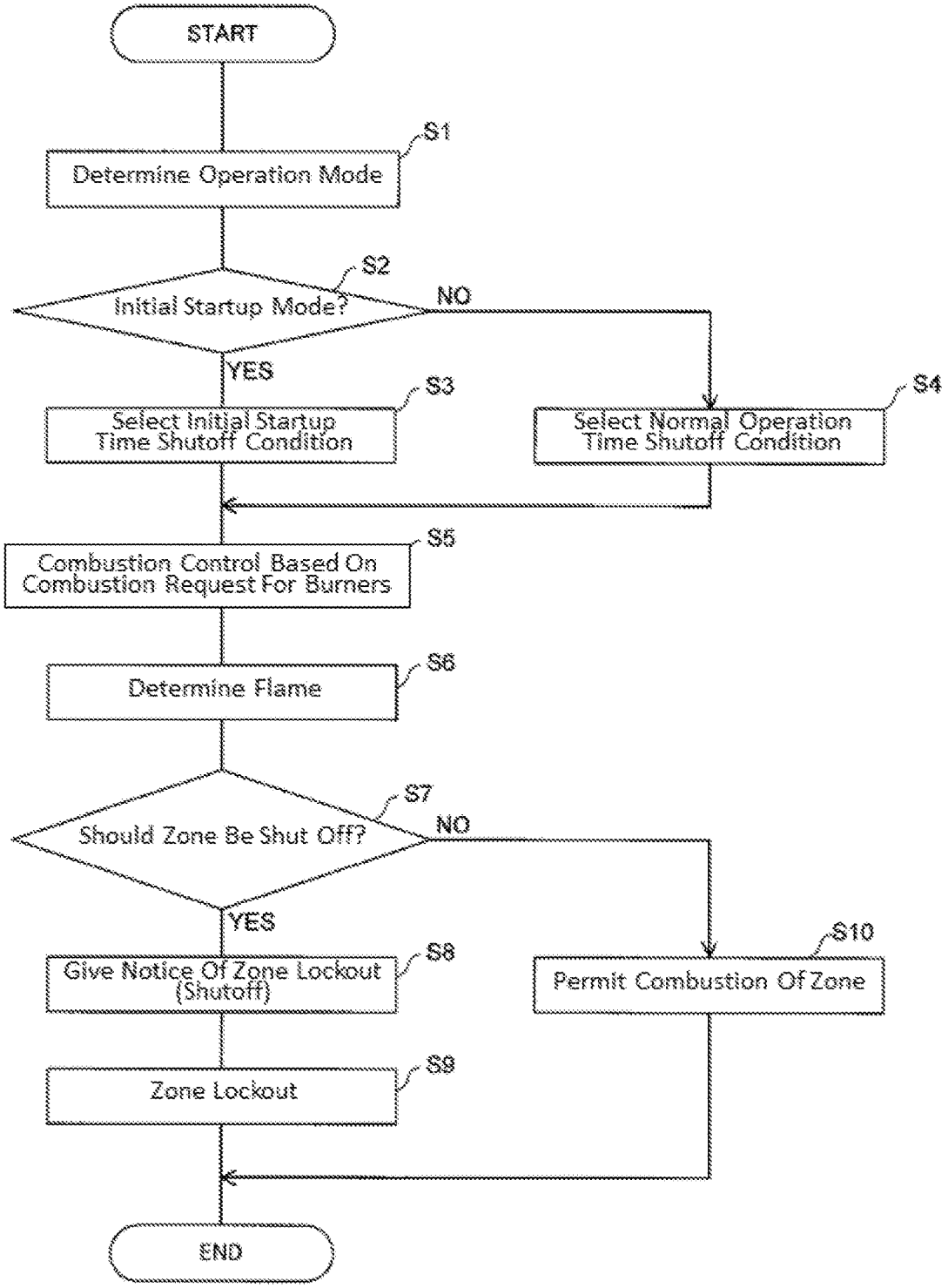
FIG. 8 is a flowchart illustrating a flow of processing of a zone lockout control by the combustion controlling device according to the embodiment.

FIG. 8 is a flowchart illustrating a flow of processing of the zone lockout control by the combustion controlling device according to the embodiment.

As illustrated in FIG. 8, in the zone lockout control, the operation mode is first determined by the operation mode setting portion 101 (S1). Then, the shutoff condition selection unit 102 determines the operation mode selected in Step S1, and selects the zone lockout condition according to a determination result (S2). Specifically, when the operation mode selected in Step S1 is the initial startup mode, the shutoff condition selection unit 102 selects the initial startup time shutoff condition 1031 (S3). On the other hand, when the operation mode selected in Step S1 is not the initial startup mode, in other words, is the normal operation mode, the shutoff condition selection unit 102 selects the normal operation time shutoff condition 1032 (S3).

Thereafter, when the combustion request for a burner is output from the controlling device 4, the combustion controlling device 1 controls the combustion of the burner on the basis of the combustion request (S5). Specifically, as described above, the ignition instruction to the burner subjected to the combustion request received by the safety controlling device 10 is output to the corresponding burner controller 11, and the burner controller 11 outputs the flame determination information on whether the flame caused by the corresponding burner is present, or not, (whether the stable flame is present, or not) to the safety controlling device 10.

The safety controlling device 10 determines the combustion states of the respective burners on the basis of the flame determination information received from the burner controllers 11 (S6). Specifically, as described above, the safety controlling device 10 determines whether the combustion states of the respective burners satisfy the zone lockout condition selected in Step S3 (or Step S4), or not (S7). When the safety controlling device 10 determines that the combustion states of the respective burners satisfy the zone lockout condition selected in Step S3 (or Step S4) (abnormal) by the determining portion 104, the safety controlling device 10 notifies the respective burner controllers 11 to stop the operation of the N number of burners in the combustion chamber to be controlled by the combustion controlling device 1 (S8). As a result, the combustion chamber to be controlled by the combustion controlling device 1 is subjected to the zone lockout (S9).

On the other hand, in Step S7, when the safety controlling device 10 determines that the combustion states of the respective burners do not satisfy the zone lockout condition selected in Step S3 (or Step S4) (normal) by the determining portion 104, the safety controlling device 10 permits the operation of the respective burners in the combustion chamber to be controlled (S10).

(Advantages of Combustion Controlling Device)

As described above, according to the combustion controlling device of the present invention, since the zone lockout condition (initial startup time shutoff condition 1031) at the time of initial startup and the zone lockout condition (normal operation time shutoff condition 1032) during the normal operation are provided, the zone lockout can be executed according to the zone lockout conditions different between the initial startup and the normal operation. According to the above configuration, as compared with the combustion controlling device having only one zone lockout condition as in the conventional art, both of the safety of the combustion and the stability (continuity) of the combustion in the combustion system can be improved.

Specifically, as described above, "a condition for stopping the operation of the N number of burners when any one of the N number of burners is not ignited" is set as the initial startup time shutoff condition 1031, and "a condition for stopping the operation of the N number of burners when M number of burners among the N number of burners are subjected to flame failure (misfire)" is set as the normal operation time shutoff condition 1032. As a result, the combustion control in which the safety is prioritized during the initial startup, and the continuity (stability) of the combustion is prioritized during the normal operation so as to avoid a reduction in temperature in the combustion chamber caused by stopping all the burners in the combustion chamber, as much as possible can be realized.

The invention made by the present inventors has been described above on the basis of the embodiments in detail. However, the present invention is not limited to the embodiments, but can be variously changed without departing from a spirit of the invention.

For example, in the above embodiment, the zone lockout control caused by the combustion controlling device 1A for controlling the combustion of the combustion chamber 20A has been described. The same zone lockout control can be performed in the combustion controlling device 1B for controlling the combustion of the combustion chamber 20B.

In addition, in the above embodiment, the case in which the zone lockout condition of one combustion chamber is separated between the initial startup and the normal operation has been described. However, the present invention is not limited to the above configuration, but the combustion control according to the present embodiment can be similarly applied to even a case in which the lockout condition of one combustion furnace including multiple combustion chambers is separated between the initial startup and the normal operation.

For example, in a combustion system including a combustion furnace with P (P is an integer of 2 or more) number of combustion chambers each having one or multiple burners, a lockout condition at the time of initial startup for igniting the burners in a desired combustion chamber from a state in which none of the combustion chambers is ignited, and a lockout condition during the normal operation after the burners in the desired combustion chamber have been normally ignited at the time of initial startup are set separately as the combustion furnace lockout condition for locking out the overall combustion furnace. Specifically, a condition for locking out all of the P number of combustion chambers when one combustion chamber is locked out is set as the combustion furnace lockout condition at the time of initial startup, and a condition for locking out all the P number of combustion chambers when S (S<P) number of combustion chambers among the P number of combustion chambers are locked out is set as the combustion furnace lockout condition during the normal operation. In that case, for example, a host device (for example, corresponding to the controlling device 4) for controlling the combustion controlling devices (corresponding to the combustion controlling devices 1A and 1B) disposed for each of the P number of combustion chambers selects the combustion furnace lockout condition according to the operation mode, determines the combustion furnace lockout according to the selected combustion furnace lockout condition, and controls the respective combustion controlling devices according to a determination result.

According to the above configuration, as in the above embodiment, both of the safety of combustion and the stability of combustion in the combustion system can be improved.

In the above embodiment, the example in which the combustion furnace 2 in the combustion system 500 has two combustion chambers 20A and 20B has been described. The number of combustion chambers in the combustion furnace 2 is not particularly restricted. For example, the combustion furnace 2 may have only one combustion chamber, or may have three or more combustion chambers.

In the above embodiment, the information on the initial startup time shutoff condition 1031 and the normal operation time shutoff condition 1032 is written in the nonvolatile memory such as a flash memory in the production or during shipment of the combustion controlling device 1. Alternatively, the information on the initial startup time shutoff condition 1031 and the normal operation time shutoff condition 1032 may be rewritten even after the production of the combustion controlling device 1, for example, during the construction of the combustion system or during the maintenance of the combustion system.

DESCRIPTION OF REFERENCE NUMERALS AND SIGNS

1, 1A, and 1B . . . combustion controlling device, 2 . . . combustion furnace, 20A and 20B . . . combustion chamber, 3 . . . fuel flow channel, 4 . . . controlling device, 21A to 24A and 21B to 24B . . . burner, 25A to 28A and 25B to 28B . . . flame detector, 31A to 34A and 31B to 34B . . . safety shutoff valve, 10 . . . safety controlling device, 11 and 11_1 to 11_4 . . . burner controller, 101 . . . operation mode setting portion, 102 . . . shutoff condition selection unit, 103 . . . storing portion, 1031 . . . initial startup time shutoff condition, 1032 . . . normal operation time shutoff condition, 104 . . . determining portion, 105 . . . instruction portion, and 500 . . . combustion system.

The invention claimed is:

1. A combustion controlling device that controls the operation of N number of burners, N being an integer of 2 or more, the combustion controlling device comprising:

a determining portion that determines combustion states of the N number of burners on the basis of a first shutoff condition for stopping the operation of the N number of burners at the time of an initial startup to ignite a desired burner from a state in which none of the burners is ignited, and a second shutoff condition for stopping the operation of the N number of burners in a normal operating state after the desired burner has been normally ignited by the initial startup;

an instruction portion that generates an instruction for stopping the operation of the N number of burners on the basis of the determination result of the determining portion;

an operation mode setting portion that sets any one of an initial startup mode for igniting the burners after performing prepurge and a normal operation mode for controlling the operation of the N number of burners in the normal operating state as an operation mode; and a shutoff condition selection unit that selects the first shutoff condition when the initial startup mode is set by the operation mode setting portion, and selects the second shutoff condition when the normal operation mode is set by the operation mode setting portion, wherein the determining portion determines whether or not the combustion states of the N number of burners satisfy one of the first shutoff condition and the second shutoff condition selected by the shutoff condition selection unit, the instruction portion generates the instruction for stopping all the operation of the N number of burners when it is determined by the determining portion that the combustion states of the N number of burners satisfy the selected one of the first shutoff condition and the second shutoff condition, and allows the operation of the N number of burners to be continued when it is determined by the determining portion that the combustion states of the N number of burners do not satisfy the selected one of the first shutoff condition and the second shutoff condition.

2. The combustion controlling device according to claim 1, wherein the first shutoff condition is a condition for stopping the operation of the N number of burners when even one of the N number of burners is not ignited.

3. The combustion controlling device according to claim 1, wherein the second shutoff condition is a condition for stopping the N number of burners when flames of M number of burners among the N number of burners are not generated, M being an integer of N or less.

4. The combustion controlling device according to claim 1, wherein the operation mode setting portion switches the operation mode from the initial startup mode to the normal operation mode when the desired burner is normally ignited in the initial startup mode.

5. A combustion system comprising:

the combustion controlling device according to claim 1;

a combustion furnace having a combustion chamber in which the N number of burners are installed; and flame detectors that are installed for the respective burners, and detect the combustion states of the respective burners.

6. The combustion system according to claim 5, wherein the combustion furnace comprises a plurality of the combustion chambers, a plurality of the combustion controlling devices is disposed for the respective combustion chambers, and the respective combustion controlling devices control the operation of the N number of burners installed in the respective combustion chambers.

7. The combustion controlling device according to claim 1, wherein the first and second shutoff conditions comprise respective different thresholds in connection with the N number of burners.

* * * * *